US010130230B2

(12) United States Patent
Moser et al.

(10) Patent No.: US 10,130,230 B2
(45) Date of Patent: Nov. 20, 2018

(54) SURFACE CLEANING MACHINE HAVING A WETTING DEVICE

(71) Applicant: Alfred Kärcher GmbH & Co. KG, Winnenden (DE)

(72) Inventors: Fabian Moser, Schorndorf (DE); Manuel Schulze, Kornwestheim (DE); Christoph Rufenach, Korntal-Muenchingen (DE); Johanna Buchmann, Stuttgart (DE); Andreas Mueller, Oppenweiler (DE)

(73) Assignee: Alfred Kärcher SE & Co. KG, Winnenden (DE)

( * ) Notice: Subject to any disclaimer, the term of this patent is extended or adjusted under 35 U.S.C. 154(b) by 0 days.

(21) Appl. No.: 15/484,631

(22) Filed: Apr. 11, 2017

(65) Prior Publication Data

US 2017/0215676 A1 Aug. 3, 2017

Related U.S. Application Data

(63) Continuation of application No. PCT/EP2015/073275, filed on Oct. 8, 2015.

(30) Foreign Application Priority Data

Oct. 13, 2014 (DE) ..... 10 2014 114 809

(51) Int. Cl.
*A47L 11/30* (2006.01)
*A47L 5/30* (2006.01)
(Continued)

(52) U.S. Cl.
CPC ..... *A47L 11/302* (2013.01); *A47L 5/30* (2013.01); *A47L 9/0477* (2013.01);
(Continued)

(58) Field of Classification Search
CPC A47L 11/302; A47L 11/4027; A47L 11/4016; A47L 11/4044; A47L 11/4083;
(Continued)

(56) References Cited

U.S. PATENT DOCUMENTS 4,668,256 A 5/1987 Billiet et al.
5,086,539 A 2/1992 Rench
(Continued)

FOREIGN PATENT DOCUMENTS

CA 2 411 936 11/2003
CH 607 578 9/1978
(Continued)

*Primary Examiner* — David Redding
(74) *Attorney, Agent, or Firm* — Womble Bond Dickinson (US) LLP

(57) ABSTRACT

A surface cleaning machine including at least one cleaning roller, a drive device for rotary driving of the at least one cleaning roller, a wetting device for applying cleaning liquid to the at least one cleaning roller, and a suction unit arrangement for generating a suction stream is provided. The suction unit arrangement is fluidically connected to at least one suction duct and at least one suction nozzle that is associated with the at least one cleaning roller. The wetting device includes at least one pressure-controlled switch that opens a fluid path for cleaning liquid to the at least one cleaning roller and shuts off the fluid path, and the at least one pressure-controlled switch is coupled to the at least one suction duct, wherein a suction stream in the at least one suction duct moves the pressure-controlled switch into the open position and/or maintains the open position.

22 Claims, 10 Drawing Sheets

(51) Int. Cl.
*A47L 9/04* (2006.01)
*A47L 11/202* (2006.01)
*A47L 11/40* (2006.01)

(52) U.S. Cl.
CPC ..... *A47L 11/202* (2013.01); *A47L 11/4008* (2013.01); *A47L 11/408* (2013.01); *A47L 11/4016* (2013.01); *A47L 11/4027* (2013.01); *A47L 11/4041* (2013.01); *A47L 11/4044* (2013.01); *A47L 11/4069* (2013.01); *A47L 11/4083* (2013.01); *A47L 11/4088* (2013.01)

(58) Field of Classification Search
CPC ..... A47L 11/4041; A47L 11/4008; A47L 11/4069; A47L 11/408; A47L 11/4088; A47L 11/29; A47L 11/30
USPC ..... 15/320
See application file for complete search history.

(56) References Cited

U.S. PATENT DOCUMENTS

| | | | |
|---|---|---|---|
| 5,350,432 | A | 9/1994 | Lee |
| 6,400,048 | B1 | 6/2002 | Nishimura et al. |
| 6,475,256 | B2 | 11/2002 | Matsubara et al. |
| 6,662,402 | B2 | 12/2003 | Giddings et al. |
| 6,735,812 | B2 | 5/2004 | Hekman et al. |
| 7,128,770 | B2 | 10/2006 | Oh et al. |
| 7,272,870 | B2 | 9/2007 | Pierce et al. |
| 7,341,611 | B2 | 3/2008 | Greene et al. |
| 7,559,963 | B2 | 7/2009 | Oh et al. |
| 7,967,914 | B2 | 6/2011 | Giddings et al. |
| 7,979,952 | B2 | 7/2011 | Beskow et al. |
| 8,016,996 | B2 | 9/2011 | Field et al. |
| 8,025,786 | B2 | 9/2011 | Field et al. |
| 2002/0194692 | A1 | 12/2002 | Giddings et al. |
| 2003/0159232 | A1 | 8/2003 | Hekman et al. |
| 2009/0089967 | A1 | 4/2009 | Yang et al. |
| 2009/0119871 | A1 | 5/2009 | Dilger et al. |
| 2010/0132150 | A1 | 6/2010 | Egler et al. |
| 2012/0222244 | A1 | 9/2012 | Conrad |
| 2013/0091663 | A1 | 4/2013 | Mersmann |
| 2014/0000060 | A1 | 1/2014 | Demirtas et al. |
| 2014/0150984 | A1 | 6/2014 | Nishikawa et al. |
| 2014/0182079 | A1 | 7/2014 | Van Der Kooi et al. |
| 2015/0082579 | A1 | 3/2015 | Lin |
| 2016/0278597 | A1 | 9/2016 | Braendle et al. |

FOREIGN PATENT DOCUMENTS

| | | |
|---|---|---|
| DE | 294 642 | 10/1991 |
| DE | 41 17 957 | 12/1992 |
| DE | 102 42 257 | 4/2003 |
| DE | 10 2004 013 262 | 9/2005 |
| DE | 10 2007 031 371 | 1/2009 |
| DE | 10 2008 013 485 | 11/2009 |
| EP | 0 012 337 | 6/1980 |
| EP | 0 186 005 | 7/1986 |
| EP | 0 844 843 | 7/2002 |
| EP | 1 535 560 | 1/2005 |
| EP | 1 465 518 | 4/2005 |
| EP | 1 736 089 | 12/2006 |
| EP | 2 177 128 | 4/2010 |
| EP | 2 387 932 | 11/2011 |
| EP | 2 721 988 | 4/2014 |
| FR | 2 797 895 | 3/2001 |
| GB | 1123052 | 8/1968 |
| GB | 2 341 124 | 3/2000 |
| GB | 2 411 823 | 9/2005 |
| GB | 2 420 967 | 6/2006 |
| GB | 2 435 820 | 9/2007 |
| JP | 2005-211350 | 8/2005 |
| WO | WO 97/06721 | 2/1997 |
| WO | WO 00/78198 | 12/2000 |
| WO | WO 02/28251 | 4/2002 |
| WO | WO 02/069775 | 9/2002 |
| WO | WO2005/089614 | 9/2005 |
| WO | WO 2005/096907 | 10/2005 |
| WO | WO 2006/102147 | 9/2006 |
| WO | WO 2006/110459 | 10/2006 |
| WO | WO 2010/041185 | 4/2010 |
| WO | WO 2010/140967 | 12/2010 |
| WO | WO 2013/027140 | 2/2013 |
| WO | WO 2013/027164 | 2/2013 |

SURFACE CLEANING MACHINE HAVING A WETTING DEVICE

CROSS-REFERENCE TO RELATED APPLICATIONS

This application is a continuation of international application number PCT/EP2015/073275 filed on Oct. 8, 2015 and claims the benefit of German application number 10 2014 114 809.6 filed on Oct. 13, 2014, which are incorporated herein by reference in their entirety and for all purposes.

BACKGROUND OF THE INVENTION

The invention relates to a surface cleaning machine, including at least one cleaning roller, a drive device for rotary driving of the at least one cleaning roller, a wetting device for applying cleaning liquid to the at least one cleaning roller, and a suction unit arrangement for generating a suction stream, which is fluidically connected to at least one suction duct and at least one suction nozzle that is associated with the at least one cleaning roller.

A surface cleaning machine of this kind enables good cleaning results to be achieved. By wetting the at least one cleaning roller, dirt on the surface to be cleaned can be moistened and so detached better. Detached dirt can be carried along by the rotating cleaning roller and removed by suction.

WO 2013/027140 A1 discloses a cleaning device for cleaning a surface that includes a rotatable brush. Further provided is a rubber wiping element that is at a spacing from the brush and is secured to an underside of a nozzle housing.

WO 2013/027164 A1 also discloses a cleaning device having a rotatable brush and a single rubber wiping element.

EP 2 177 128 A1 discloses a device for distributing fluid on a brush.

DE 41 17 157 A1 discloses a method for cleaning or swabbing a preferably smooth surface, in which the surface to be cleaned is wiped off with a substantially cloth-like wiping element, during which dirt is taken up by the wiping element, and then the dirty wiping element is moistened and thereafter the dirt is removed from the wiping element by suction.

WO 2010/140967 A1 discloses a method for cleaning a dirty surface.

CH 607 578 discloses a brush device that is connectable to a water line.

EP 0 186 005 A1 discloses a brush suction nozzle that is provided with wheels.

FR 2 797 895 discloses a brush.

US 2002/0194692 A1 discloses a method for mechanically removing dirt from a surface.

DE 1 503 858 discloses a device for cleaning and/or for the care of textile floor coverings such as carpets, during which liquid cleaning or care products are applied, having a treatment head that is movable to and fro over the surface to be treated. Devices for application and where necessary distribution of the liquid and any mechanically operating cleaning members in the treatment head are arranged in the area of influence of a stream of suction air that removes the applied liquid from the treated material again by suction once the cleaning function is complete.

SUMMARY OF THE INVENTION

In accordance with the present invention, a surface cleaning machine is provided, which has optimized operating properties.

In accordance with an embodiment of the invention, the wetting device comprises at least one pressure-controlled switch that, in an open position, opens a fluid path for cleaning liquid to the at least one cleaning roller and, in a closed position, shuts off the fluid path, and the at least one pressure-controlled switch is coupled to the at least one suction duct in a manner activated by pressure, wherein, in the event of the application of a negative pressure brought about by a suction stream in the at least one suction duct, the at least one pressure-controlled switch moves into the open position and/or maintains the open position.

In the solution according to the invention, the application of fluid to the at least one cleaning roller is coupled to a suction mode. Whether cleaning liquid can be applied to the at least one cleaning roller at all or not depends on a suction mode of the suction unit arrangement.

Conventionally, the surface cleaning machine is operated in a cleaning mode such that removal by suction is performed. This means that in principle it is possible in this operating mode for cleaning liquid to be applied to the at least one cleaning roller.

There is no need for an additional, higher-level control for this application of cleaning liquid. Further, the application may be carried out without pumps. No solenoid valves or similar are required. Consequently, the surface cleaning machine can take a structurally simple form. There is no power consumption by pumps, solenoid valves, etc.

In principle, one or more pressure-controlled switches may be provided, depending on the envisaged application.

It is favorable if at least one collecting space is provided for cleaning liquid, wherein the fluid path that is controllable, in terms of opening and closing, by the at least one pressure-controlled switch lies between the at least one collecting space and the at least one cleaning roller. In particular, cleaning liquid may be supplied to the collecting space from a reservoir device for cleaning liquid. It is possible to ensure that there is always cleaning liquid ready in the collecting space and that, when the pressure-controlled switch is opened, this cleaning liquid may be supplied to the at least one cleaning roller. The collecting space may for example be formed by the interior of a (cleaning liquid) line that leads to the pressure-controlled switch, or by a chamber at which the switch is arranged (and into which a line leads).

It is most particularly advantageous if a reservoir device for cleaning liquid is provided that is fluidically connected to the fluid path and is in particular fluidically connected to the at least one collecting space for cleaning liquid. This allows a top-up of cleaning liquid to be ensured, provided there is still cleaning liquid in the reservoir device.

For the reasons mentioned above, it is advantageous if there is always cleaning liquid from the reservoir device ready at the at least one collecting space. For this, a (principal) shut-off valve may be provided by means of which this always-ready supply is switchable. This has the effect that for example a cleaning mode without the application of cleaning liquid can be set.

In a structurally simple embodiment, in a normal operating mode of the surface cleaning machine, the reservoir device is located above the at least one cleaning roller in relation to the direction of gravity. It is then possible to convey cleaning liquid from the reservoir device to the at least one cleaning roller without pumps, under the effect of gravity. Normal operating mode is a mode in which the surface cleaning machine is standing, by way of the at least one cleaning roller, on the surface to be cleaned and a person operating it is also standing on the surface to be cleaned and at the same time an upper end of the surface cleaning machine, remote from the cleaning head, is located above the cleaning head in relation to the direction of gravity.

It is most particularly advantageous if the at least one pressure-controlled switch has a first surface, which is connected to the at least one suction duct in a manner activated by pressure, and a second surface, which is connected to the outside in a manner activated by pressure, wherein a pressure difference between the first surface and the second surface determines the position of the at least one pressure-controlled switch. Consequently, purely by way of the pressure on the first surface, it is possible to control whether the at least one pressure-controlled switch is open or closed. A corresponding pressure-controlled switch can take a simple form.

In particular, the application of a negative pressure on the at least one suction duct brings about a pressure difference between the first surface and the second surface that moves the at least one pressure-controlled switch into the open position and/or keeps it in the open position. Consequently, a direct link is made between application of cleaning liquid to the at least one cleaning roller and a suction mode.

Favorably, the at least one pressure-controlled switch has a reset device which, if a minimum threshold of the pressure difference is not reached, performs a reset to the closed position and/or maintains the closed position. Consequently, if the application of negative pressure on the first surface ceases, it is possible to perform a reset, shutting off the fluid path automatically.

In principle, the reset device may be formed by way of a resilient device that includes for example additional springs or similar. In a structurally simple embodiment, the reset device is formed by an inherent resilience of the at least one pressure-controlled switch.

In an advantageous embodiment, the at least one pressure-controlled switch has a movable membrane. Depending on the prevailing pressure difference, the membrane can move and bring about a transfer from the open to the closed position or vice versa.

Further, it is structurally favorable if the at least one pressure-controlled switch has at least one movable shut-off element for the fluid path, arranged in particular at a movable membrane. This allows shutting off and opening to be achieved in a simple manner. Further, by providing a membrane having an inherent resilience, a reset device may be produced in a structurally simple manner.

It is most particularly advantageous if there is arranged downstream of the at least one pressure-controlled switch a distributor for distributing cleaning liquid to the at least one cleaning roller, and this distributor is fluidically connected to the fluid path. Using the distributor, it is possible to apply cleaning liquid evenly to the at least one cleaning roller, in particular over an entire length of the cleaning roller.

In one exemplary embodiment, the distributor is formed by a channel or includes at least one channel. A channel has a half-shell shape. Depending on the position of the at least one channel relative to an outlet opening device in relation to the direction of gravity, cleaning liquid may or may not be applied to the at least one cleaning roller in an operator-controlled manner and hence in a gravity-controlled manner.

In particular, the at least one channel extends at least approximately parallel to a longitudinal axis of the at least one cleaning roller and/or extends at least approximately parallel to an axis of rotation of the at least one cleaning roller. This enables liquid to be applied evenly in a simple manner.

It is further favorable if the at least one channel extends, by means of an outlet opening device, over at least 80% of a length of the at least one cleaning roller and in particular over an entire length of the at least one cleaning roller. In this way, a good cleaning effect is achieved over the entire length of the at least one cleaning roller.

The at least one channel has for example a half-shell shape. This allows an intermediate buffer for cleaning liquid to be produced in a simple manner. Depending on the gravitational potential of the at least one channel in relation to an outlet opening device, it is possible for a liquid to be applied or not applied to the at least one cleaning roller in an operator-controlled manner.

It is favorable if the distributor has an outlet opening device that is arranged and formed such that, depending on an angular position of the distributor in relation to the direction of gravity, cleaning liquid flows or does not flow out of the distributor to the at least one cleaning roller. This allows the application of liquid to be adjusted in a gravity-controlled manner.

In particular, the angular position of the distributor in relation to the direction of gravity is determined by an angular position of a longitudinal axis of the surface cleaning machine (and hence of the entire machine) in relation to a surface to be cleaned. This angular position can be altered by a person operating the machine in a simple manner, by raising or lowering by a handle.

In particular, the at least one cleaning roller is then wetted by way of the distributor in a gravity-controlled manner.

It is most particularly advantageous if, in regard to wetting the at least one cleaning roller with the wetting device, the surface cleaning machine takes a form without pumps. The result is a construction that is structurally simple and space-saving. Further, no additional energy consumer such as a pump is required.

In one embodiment, the fluid path has at least one slot channel that in particular takes a form such that a capillary effect occurs for the flow of cleaning liquid. In particular, the slot channel is downstream of a distributor. In this way, an even application of liquid to the at least one cleaning roller over its length can be achieved. The at least one slot channel is preferably dimensioned such that a capillary effect occurs even if the cleaning liquid contains detergent.

For the same reason, it is favorable if a jacket of the at least one cleaning roller abuts, or almost abuts, against an outlet opening device of the at least one slot channel. Textile fibers of the jacket of the at least one cleaning roller can temporarily cover one or more openings at the outlet opening device and so generate a negative pressure. This improves distribution.

In particular, a distributor for cleaning liquid is upstream of the at least one slot channel, in relation to a direction of flow for cleaning liquid. This allows even application of liquid to the at least one cleaning roller over its length.

In particular, in a cleaning mode the surface cleaning machine is supported on the surface to be cleaned, by way of a cleaning roller that is driven in rotation. The person operating the machine stands on the surface to be cleaned. This results in an optimized cleaning effect, wherein the corresponding surface cleaning machine may take a space-saving form with relatively small dimensions, and may be made in a structurally simple manner.

The description below of preferred embodiments serves, together with the drawings, to explain the invention in more detail.

DETAILED DESCRIPTION OF THE INVENTION

Figure 1:
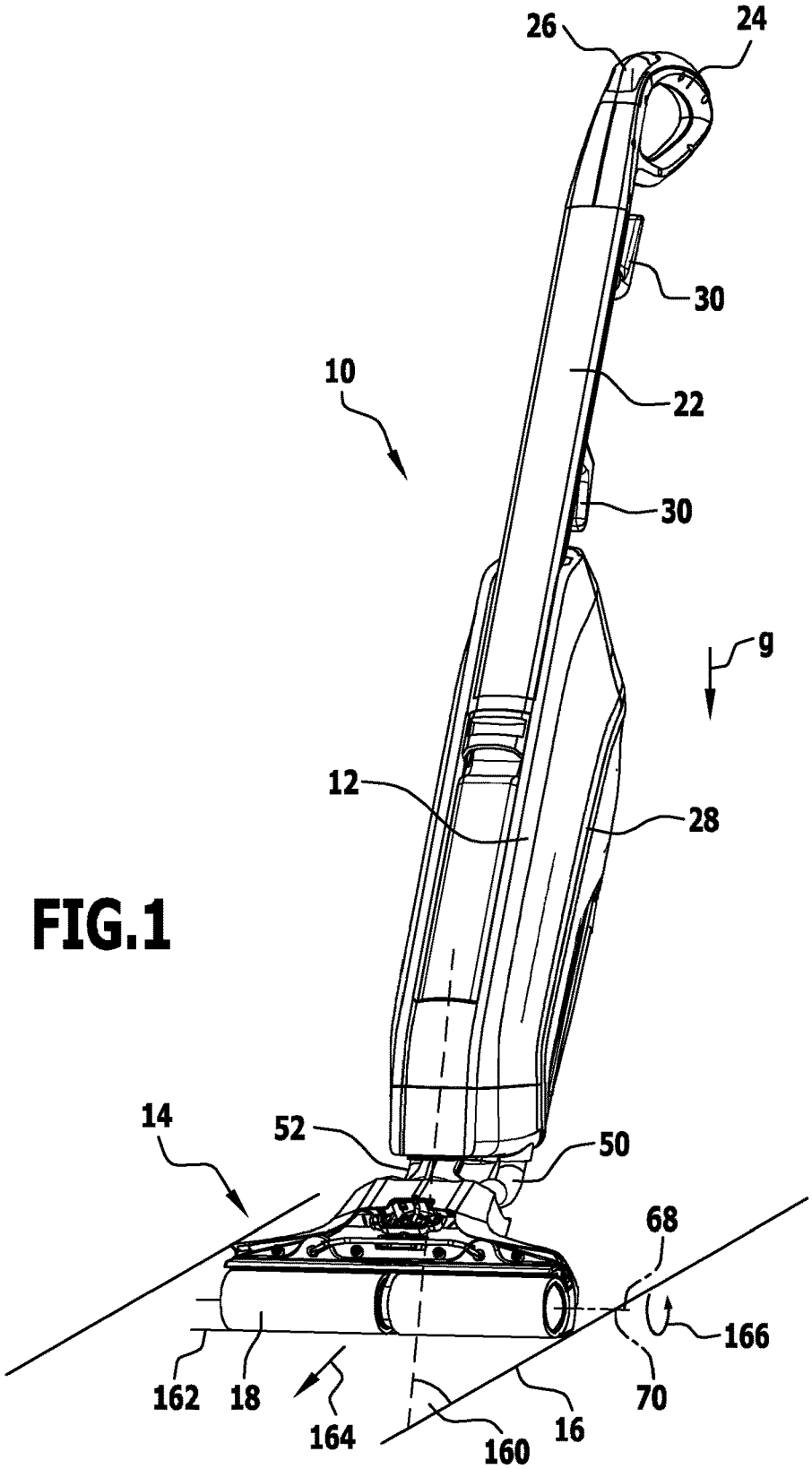
FIG. 1 shows a perspective illustration of an exemplary embodiment of a surface cleaning machine according to the invention.

One exemplary embodiment of a surface cleaning machine according to the invention, which is shown in FIGS. 1 to 4 (and in FIGS. 5 to 10 in partial illustrations) and is designated 10 there, takes the form of a floor cleaning machine for hard floors.

The surface cleaning machine 10 includes a device body 12 and a cleaning head 14. The cleaning head 14 is arranged on the device body 12.

During a cleaning operation on a surface 16 to be cleaned, the surface cleaning machine 10 is supported on the surface 16 to be cleaned, by way of a cleaning roller 18.

Figure 2:
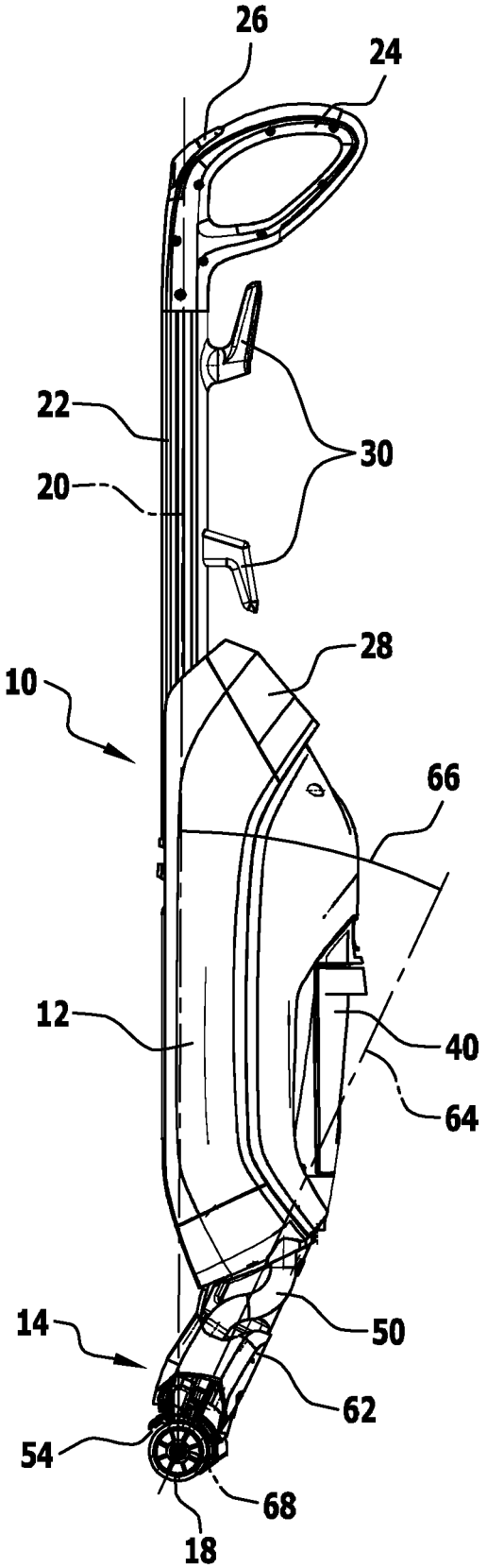
FIG. 2 shows a side view of the surface cleaning machine in FIG. 1.
Figure 3:
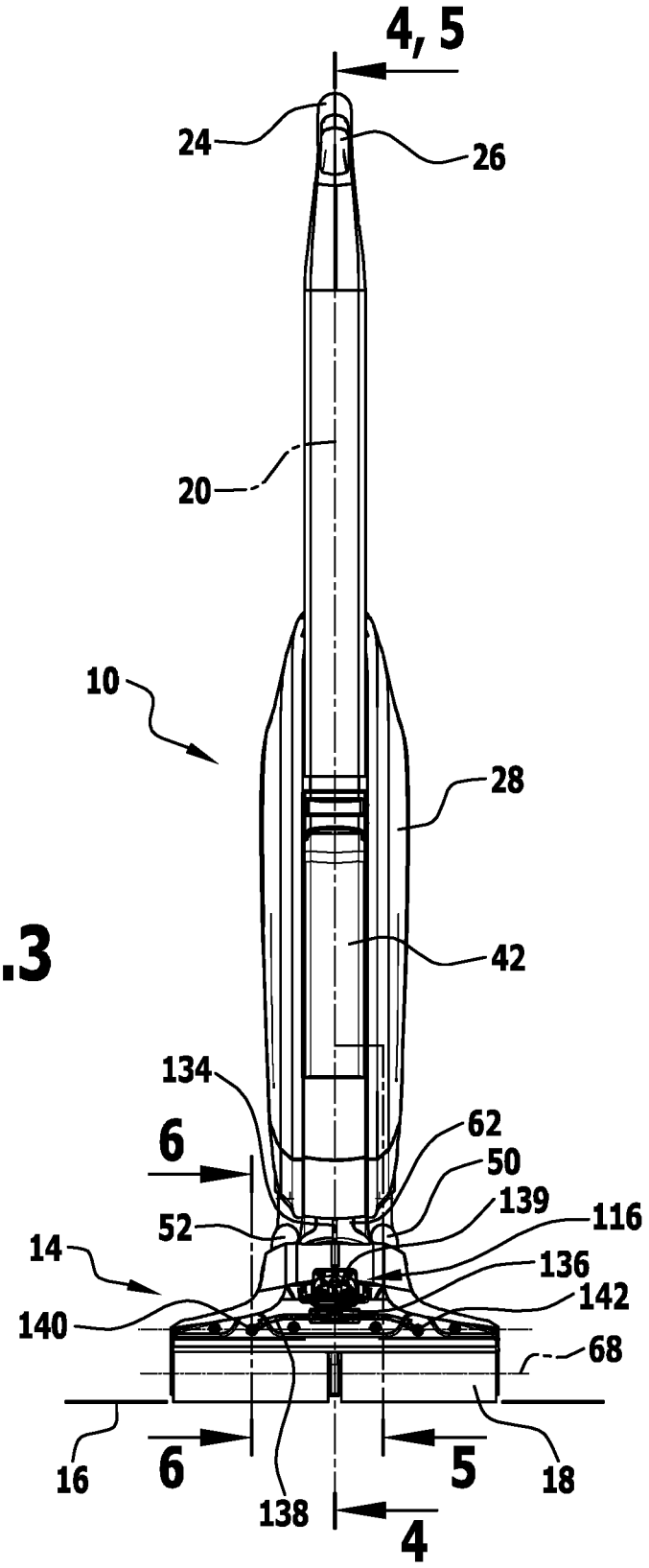
FIG. 3 shows a front view of the surface cleaning machine in FIG. 1.

The device body 12 has a longitudinal axis 20 (FIGS. 2, 3). The surface cleaning machine 10 is held by an elongate handle. For this purpose, a rod 22 is seated on the device body 12. This rod 22 extends along the longitudinal axis 20. In an upper region of the rod 22 there is arranged a handle, in particular a stirrup-shaped handle 24. A person operating the surface cleaning machine 10 can hold it with one hand by this handle 24.

Arranged on the handle 24 are one or more operating elements. In particular, a switch 26 is arranged on the handle 24. By way of the switch 26, the surface cleaning machine 10 may be switched on or off for a cleaning mode.

In particular, control of the surface cleaning machine 10 is such that actuation of the switch 26 actuates all the components required for functioning (generation of a suction stream by a suction unit arrangement, rotation of the cleaning roller 18, wetting of the cleaning roller 18), and accordingly switching off at the switch 26 brings about a synchronous switch-off of actuation of these components.

The rod 22 may be arranged on the housing body 12 such that it is height-adjustable (along the longitudinal axis 20) or fixed.

The device body 12 includes a housing 28 in which components of the surface cleaning machine 10 are arranged in protected manner.

In one exemplary embodiment, there is arranged on the rod 12 between the housing 28 and the handle 24 a hook device 30 to which a mains cable is fixable to the rod 22 by being wound around.

The surface cleaning machine 10 includes a suction unit arrangement that is designated 32 as a whole. This suction unit arrangement 32 serves to generate a suction stream in order to enable removal by suction at the cleaning roller 18.

The suction unit arrangement 32 includes a suction fan 34 that is arranged in the housing 28. The suction fan 34, for its part, has a motor, in particular an electric motor 36, which is likewise arranged in the housing 28.

Associated with the suction unit arrangement 32 is a separating device 38. The latter separates solid constituents off from liquid constituents in a suction stream.

The separating device 38 is likewise arranged in the housing 28.

Associated with the separating device 38 is a reservoir device 40 for dirty liquid. This reservoir device 40 is removably seated on the housing 28.

A reservoir device 42 for cleaning liquid is further removably seated on the housing 28. The cleaning liquid is in particular water or a mixture of water and detergent.

The suction unit arrangement 32 is fluidically connected to (at least) one suction duct 44 that is guided from the suction fan 34 on the housing body 12, through the housing 28 to the cleaning head 14. The suction duct 44 has a first region 46 that is located in the housing 28. In one exemplary embodiment, there is seated in the housing 28, at the first region 46, a branch point 48 that branches into a second region 50 and a third region 52 of the suction duct 44. This divides the first region 46 into two sub-ducts. The second region 50 and the third region 52 each lead to the cleaning head 14.

Associated with the second region 50 and the third region 52 is a respective suction nozzle 54 that is located at the cleaning head 14.

Figure 9:
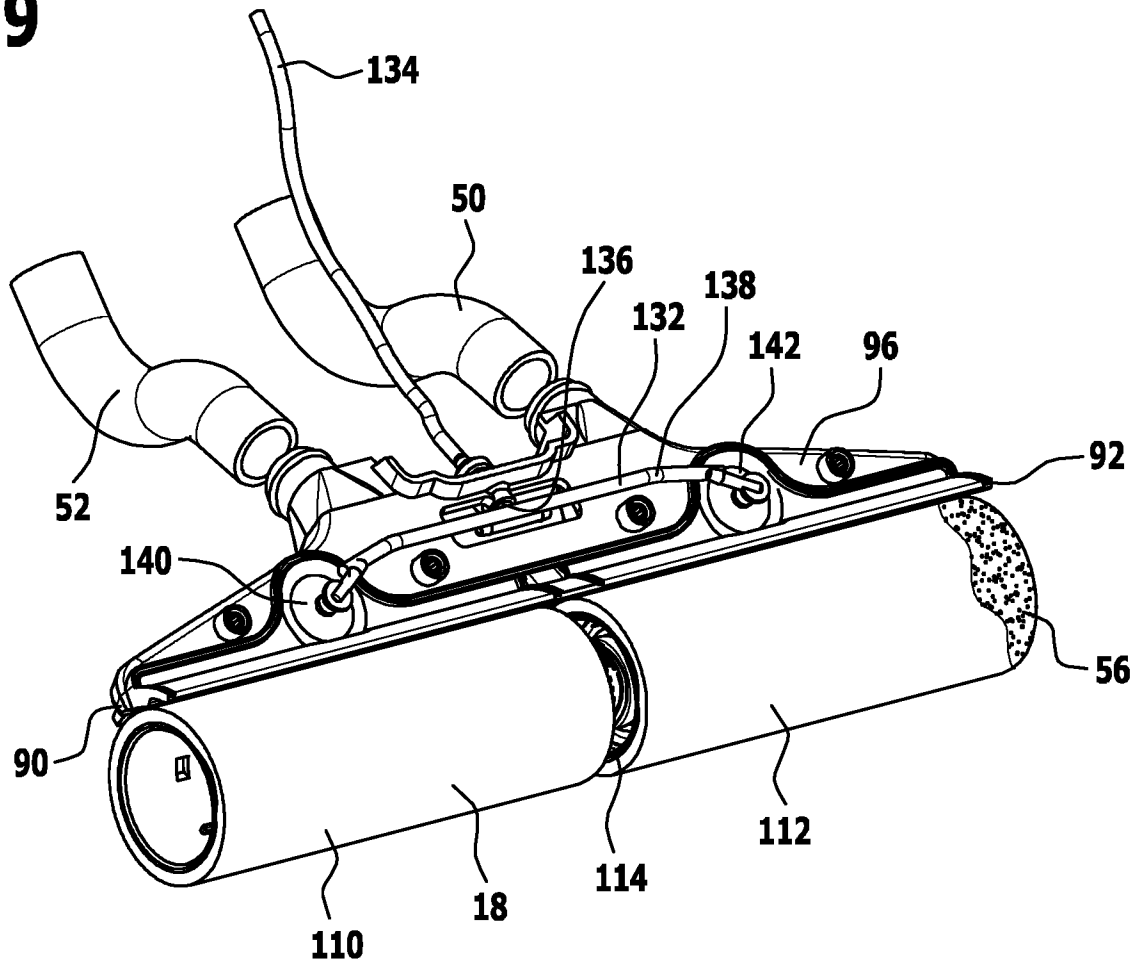
FIG. 9 shows a perspective partial view of a cleaning head of the surface cleaning machine in FIG. 1.

Arranged on the cleaning roller 18 is a jacket 56 (FIG. 9). This jacket is for example a fleece material.

Figure 5:
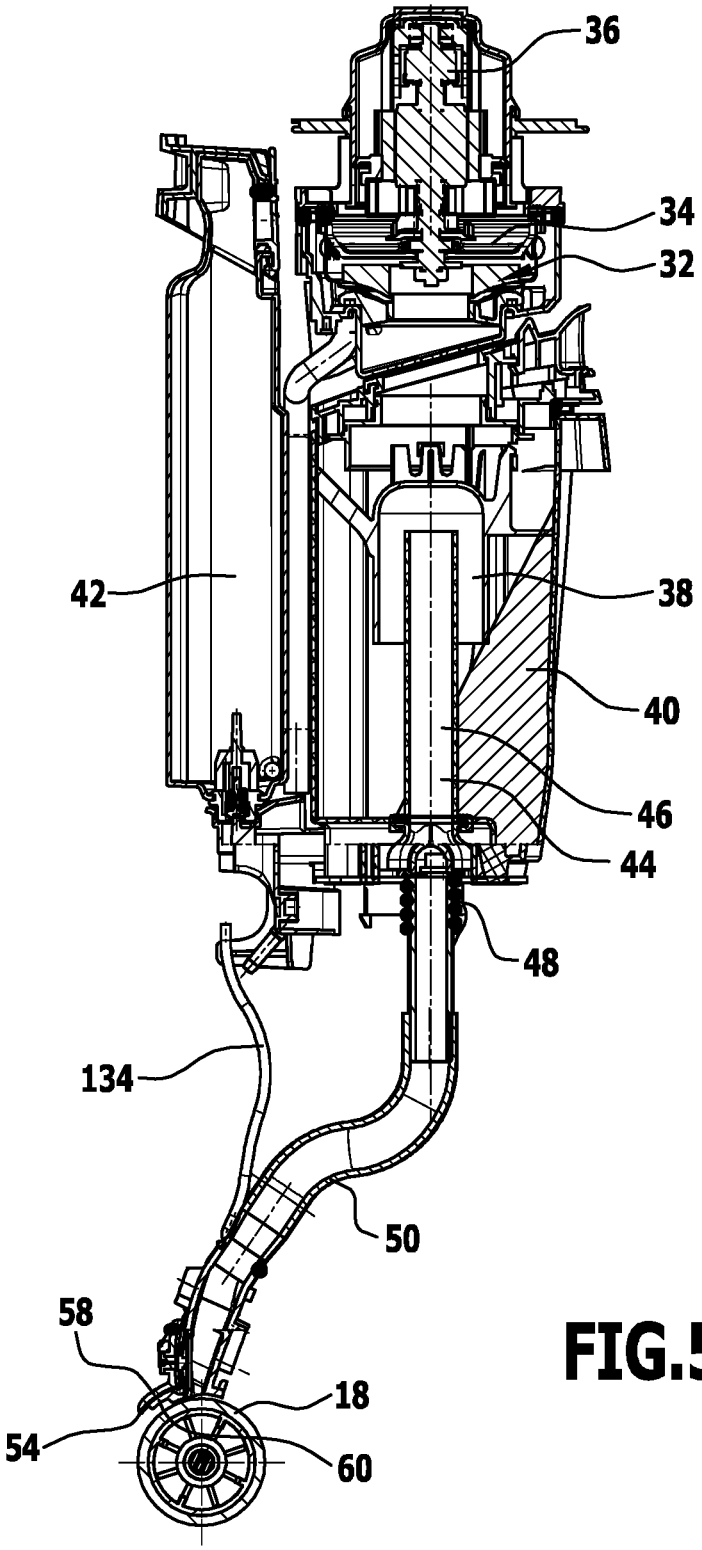
FIG. 5 shows a sectional view along the lines 5-5 in FIG. 3.

In one exemplary embodiment, the suction nozzle has a first nozzle wall 58 and a second, spaced nozzle wall 60 (FIG. 5). The respective suction nozzle 54 is formed between the first nozzle wall 58 and the second nozzle wall 60. The first nozzle wall 58 lies above the second nozzle wall 60 when the cleaning roller 18 is placed on the surface 16 to be cleaned. The first nozzle wall 58 and/or the second nozzle wall 60 abut against the jacket 56 on the cleaning roller 18 or project into the jacket 56. A corresponding form for a nozzle is described in international application PCT/EP2013/076445, dated 12 Dec. 2013, of the same Applicant, which is not a prior publication. Reference is explicitly made to the content of that document in its entirety, which is incorporated by reference in its entirety.

In principle here, a separate suction nozzle 54 may be associated with the second region 50 and with the third region 52, or a common suction nozzle for the second region 50 and the third region 52 of the suction duct 44 may be provided. This one suction nozzle 54 then has two suction removal points, by way of the second region 50 and the third region 52.

In principle, the suction unit arrangement 32 may also take a form with no branch point, and may include a plurality of (in particular two) suction ducts (two first regions 46) that are arranged in the housing 28. These then continue into the second region 50 and the third region 52 respectively.

Figure 4:
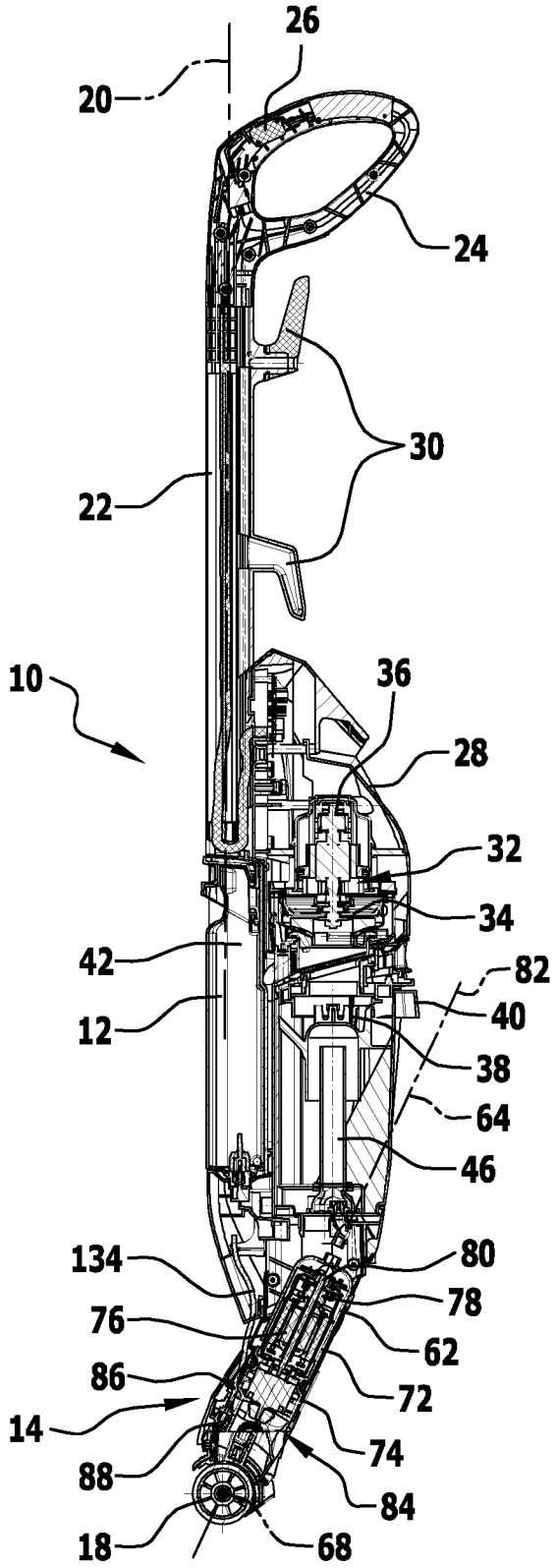
FIG. 4 shows a sectional view along the line 4-4 in FIG. 3.

The cleaning head 14 is held on the housing body 12 by way of a joint 62, pivotally about a pivot axis 64 (FIG. 2, FIG. 4). The pivot axis 64 lies transversely to the longitudinal axis 20 of the device body 12. It is in particular at an acute angle 66 (FIG. 2) to the longitudinal axis 20. The acute angle 66 is in particular in the range between 15° and 35°. In one exemplary embodiment, the acute angle 66 is approximately 25°.

The pivot axis 64 lies transversely and in particular perpendicular to an axis of rotation 68 of the cleaning roller 18.

The cleaning roller 18 has a longitudinal axis 70. The longitudinal axis 70 is in particular coaxial with the axis of rotation 68.

The pivot joint includes an inner sleeve 72 (cf. for example FIG. 4), which is arranged on the device body 12, in accordance with the orientation of the pivot axis 64, at an acute angle 66 to the longitudinal axis 20.

The cleaning head 14 has an outer sleeve 74 that is seated on the inner sleeve 72. A corresponding shut-off device ensures that the outer sleeve 74 is not displaceable in the direction of the pivot axis 64 in relation to the inner sleeve 72.

The inner sleeve 72 has a cylindrical external contour. The outer sleeve 74 has a cylindrical internal contour. The joint 62 takes the form of a joint that slides over the rotatable bearing of the outer sleeve 74 on the inner sleeve 72.

In principle, the capacity for pivoting about an angle of a full 360° may be provided. In one exemplary embodiment, the pivoting capacity is limited for example to a range around ±45° or ±90°.

A line for the regions 50, 52 between the device body 12 and the cleaning head 14 is made appropriately resilient to enable pivoting of the cleaning head 14 (in particular in a limited pivot range) on the joint 62.

A drive device 76 is provided for rotary driving of the cleaning roller 18. The drive device 76 includes a drive motor 78. This drive motor 78 is in particular an electric motor. The drive motor 78 is located in the inner sleeve 72 of the joint 62.

The drive motor 78 has a motor shaft 80. The motor shaft 80 has a drive axis 82. The drive axis 82 is parallel to, and in particular coaxial with, the pivot axis 64.

The drive motor 78 is fixedly seated in the inner sleeve 72 on the device body 12. It is located at the point of transition from the device body 12 to the cleaning head 14, to be precise at the joint 62. Here, it is accommodated in space-saving manner and lies in the vicinity of the cleaning head 14 in relation to a center of gravity of the surface cleaning machine 10.

The drive motor 78 is for example supplied with electrical energy by way of mains current.

The drive axis 82 of the drive motor 78 and the axis of rotation 68 of the cleaning roller 18 are oriented transversely in relation to one another and in particular are oriented perpendicular to one another. For the purpose of transmitting torque from the drive device 76 to the cleaning roller 18, a transmission 84 is provided. In one exemplary embodiment, the transmission 84 includes a speed reducer 86. The speed reducer 86 serves to reduce the speed of rotation, relative to the speed of the motor shaft 80. The drive motor 78 is in particular a standard electric motor that has for example a speed in the order of magnitude of 7,000 revolutions per minute. The speed reducer 86 provides a reduction in the speed to for example approximately 400 revolutions per minute.

The speed reducer 86 is in particular arranged directly on the drive motor 78, that is to say it is arranged in the immediate vicinity thereof. In this context, it may also be arranged in the inner sleeve 72 or right on the cleaning head 14.

In one exemplary embodiment, the speed reducer 86 takes the form of a planetary gear system.

The transmission 84 further has an angular gear 88. This angular gear 88 ensures redirection of the torque, in order to drive the cleaning roller 18 with the axis of rotation 68 transverse to the drive axis 82 of the drive motor 78. The angular gear 88 is in particular downstream of the speed reducer 86.

In one exemplary embodiment, the angular gear 88 has one or more gearwheels that are coupled to a corresponding shaft of the speed reducer 86 such that they cannot rotate in relation thereto. These act on a bevel gearwheel for the purpose of altering the angle.

Figure 10:
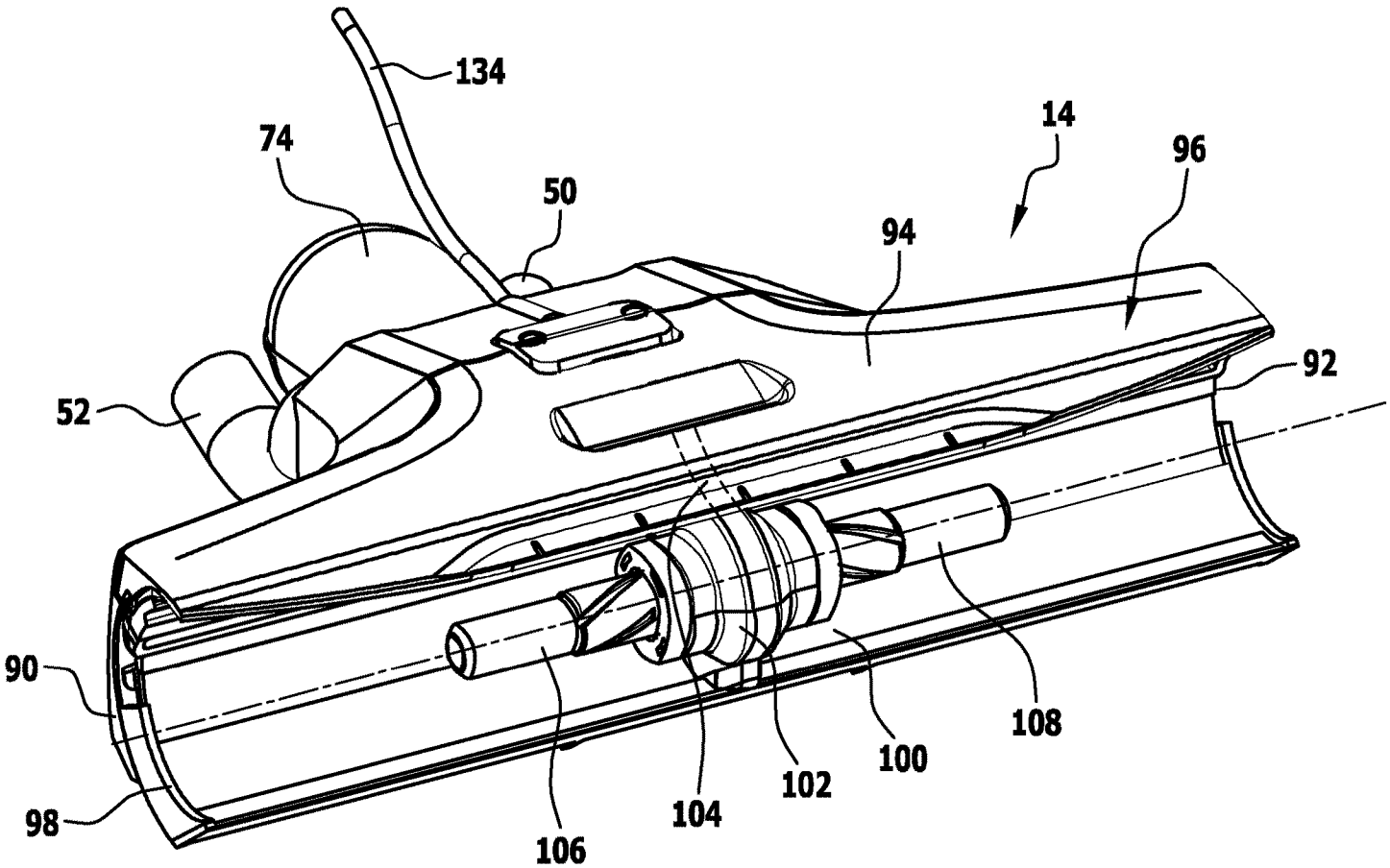
FIG. 10 shows a further view of the cleaning head, without the cleaning roller.

The cleaning head 14 has a first end side 90 and an opposite second end side 92 (see for example, FIG. 10). A housing 94 of a cleaning roller holder 96 extends between the first end side 90 and the second end side 92. This housing 94 partly embraces, in the form of a half shell, a cleaning roller 18 that is held thereon, wherein this embracing is such that the cleaning roller 18 projects out by a significant proportion for a cleaning operation.

In one exemplary embodiment, a sweeping element 98 is rotatably mounted on the housing 94 of the cleaning roller holder 96, wherein this sweeping element 98 serves to sweep coarse dirt inwards for the cleaning roller 18 to carry along.

A cleaning head 14 having a corresponding sweeping element 98 is described in German patent application 10 2014 114 776.6, dated 13 Oct. 2014, of the same Applicant. Reference is explicitly made to the content of that document in its entirety, the entirety of which is incorporated by reference herein.

In a central region 100 of the cleaning roller holder 96, between the first end side 90 and the second end side 92, there is arranged a drive element 102. This drive element 102 is connected to the drive device 76 in a manner activated by torque.

In one exemplary embodiment, the drive element 102 is coupled to the angular gear 88 in a manner activated by torque by way of a belt 104. The drive element 102 is at a spacing from the angular gear 88. The belt 104 bridges this spacing and brings about driving of the drive element with rotation about the axis of rotation 68.

A first pin 106 is arranged on the drive element 102 such that it cannot rotate in relation thereto, towards the first end side 90. A second pin 108 is arranged such that it cannot rotate in relation to the drive element, towards the second end side 92.

The cleaning roller 18 (for example, FIG. 9) is made in two parts, with a first part 110 that is seated on the first pin 106 such that it cannot rotate in relation thereto, and a second part 112 that is seated on the second pin 108 such that it cannot rotate in relation thereto. The first part 110 is directed towards the first end side 90. The second part 112 is directed towards the second end side 92.

Between the first part 110 and the second part 112 there is formed a gap 114. This gap 114 is made relatively narrow and has a very much smaller width than a length of the cleaning roller 18 along the longitudinal axis 20. The belt 104 is guided in the gap 114. The belt 104 is recessed here from an outside of the cleaning roller 18, and even from a position in which the jacket 56 is compressed.

Figure 6:
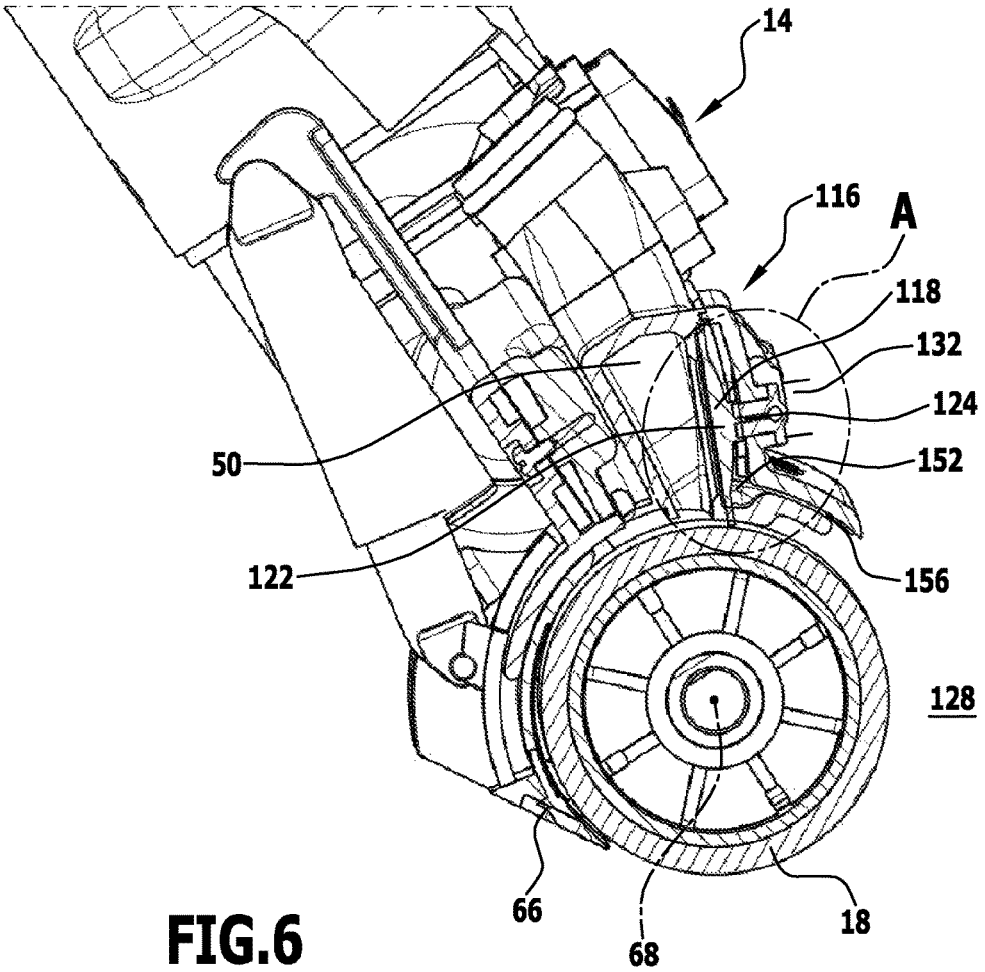
FIG. 6 shows an enlarged illustration of a front region of a cleaning head of the surface cleaning machine in FIG. 1, in a side sectional view along the line 6-6 in FIG. 3.
Figure 7:
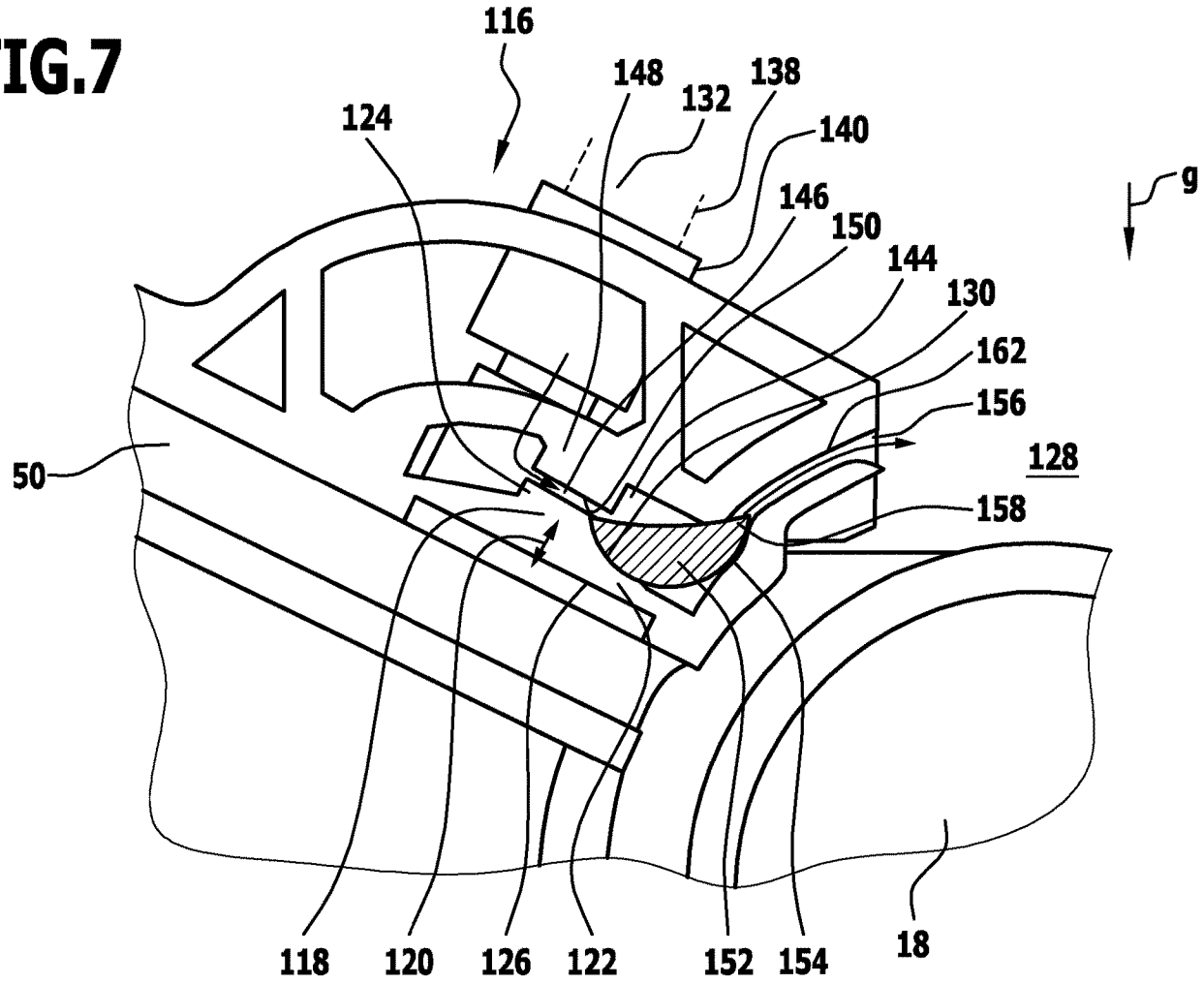
FIG. 7 shows an enlarged illustration of the region A in FIG. 6, in a first position.
Figure 8:
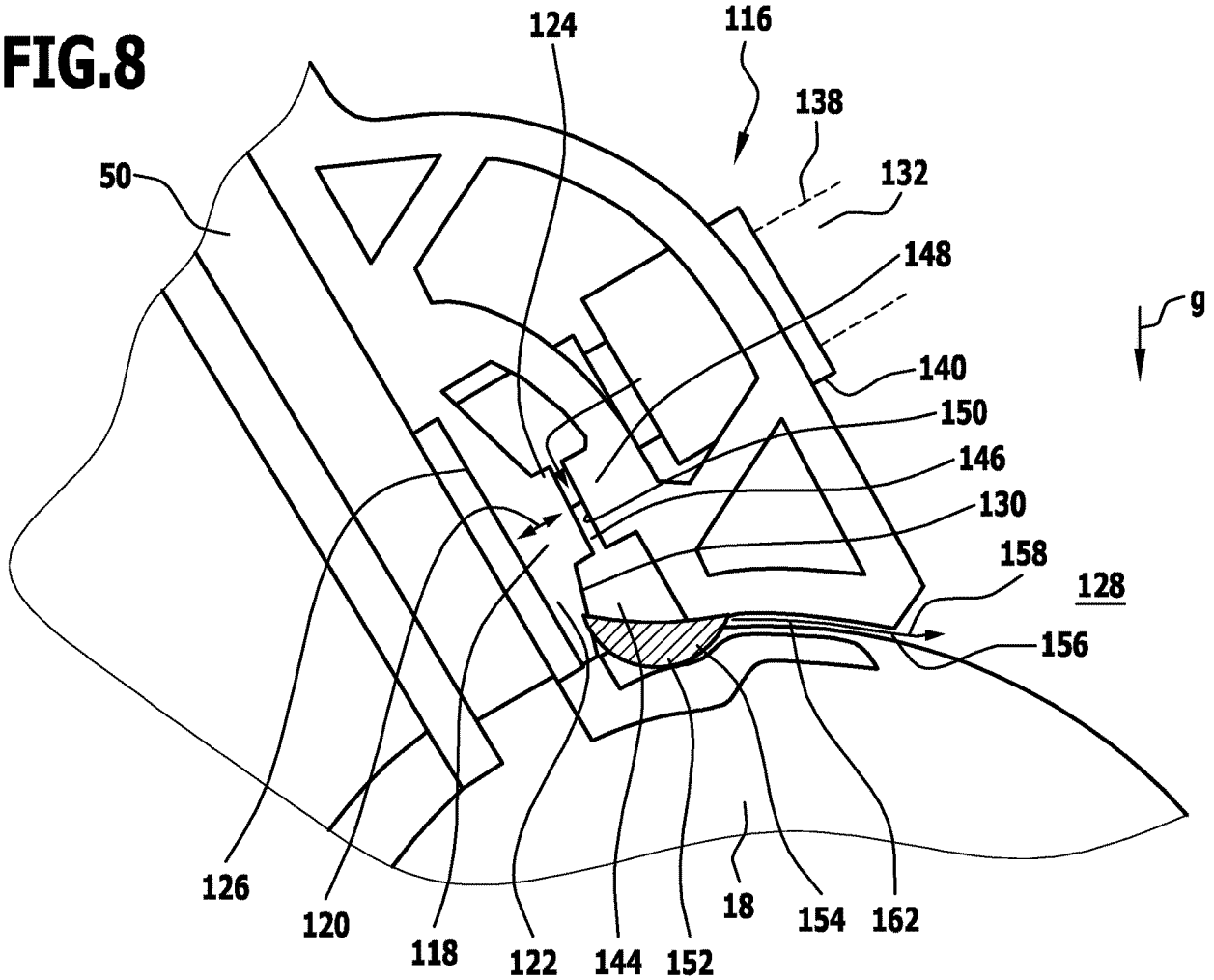
FIG. 8 shows a similar illustration to FIG. 7, in another position in relation to the direction of gravity.

The surface cleaning machine 10 includes a wetting device 116 for the cleaning roller 18 (in particular FIGS. 6 to 8).

The wetting device includes (at least) one pressure-controlled switch 118. This pressure-controlled switch 118 is movable. (In FIGS. 7 and 8, this is indicated by the double-headed arrow 120.) The pressure-controlled switch 118 includes a movable membrane 122 on which a shut-off element 124 is seated, for example in one piece therewith. As a result of the movability of the membrane 122, the shut-off element 124 is also movable. The membrane 122 has a first surface 126. This first surface 126 is connected, in a manner activated by pressure, to the suction duct 44 and hence to the second region 50 and the third region 52. The pressure prevailing in the second region 50 (and the third region 52) acts on the first surface 126. In a cleaning mode of the surface cleaning machine 10, because of the suction stream this pressure is a negative pressure in relation to the outside 128 beyond the surface cleaning machine 10.

Opposite the first surface 126, the membrane 122 has a second surface 130.

The membrane 122 is fluidically connected to a collecting space 132. The collecting space 132 may receive cleaning liquid.

The collecting space 132 is fluidically connected, by way of a line 134, to the reservoir device 42 for cleaning liquid.

The line 134 is guided through the device body 12, from the reservoir device 42 to the cleaning head 14. It takes a flexible form such that it does not hamper the capacity of the cleaning head 14 for pivoting (in particular over an infinite pivot range) on the device body 12 about the joint 62.

In one exemplary embodiment (FIG. 9), a plurality of pressure-controlled switches 118 are arranged on the cleaning head 14.

In the exemplary embodiment shown, the cleaning head 14 includes two pressure-controlled switches 118. One pressure-controlled switch 18 is connected in a manner activated by pressure to the second region 50, and a further pressure-controlled switch 118 is connected in a manner activated by pressure to the third region 52.

The line 134 leads into a distributor line 138 at a connector 136 (which is in particular a T piece). The distributor line 138, for its part, opens into the housing 94 at a first connector point 140 and a second connector point 142. A respective associated pressure-controlled switch 118 is arranged downstream of the first connector point 140 and the second connector point 142. The distributor line 138 forms the collecting space 132.

A shut-off valve 139 is arranged between the distributor line 138 and the reservoir device 42, on the line 134. This valve is in particular manually actuatable. As a result of the shut-off valve 139, a fluidic connection between the reservoir device 42 and a fluid input of a pressure-controlled switch 118 may be shut off.

In principle, it is also possible to provide more than two pressure-controlled switches 118 with corresponding connector points and collecting spaces, in which case a collecting space may also be associated with a plurality of switches 118, or only a single pressure-controlled switch 118 may be provided with only one collecting space 132.

With reference to a normal operating mode in which the cleaning roller 18 is supported on the surface 16 to be cleaned and a person operating the surface cleaning machine 10 stands on the surface 16 to be cleaned and at the same time holds the surface cleaning machine by the handle 24, wherein the handle 24 is located above the surface 16 to be cleaned in relation to the direction of gravity g, the reservoir device 42 for cleaning liquid is located above the cleaning head 14. This enables cleaning liquid to be conveyed out of the reservoir device 42 to the cleaning head 14 without pumps, i.e., driven by gravity (provided the shut-off valve 139 is open).

In particular, the collecting space 132 is constructed in cooperation with the pressure-controlled switch 118 such that there is always cleaning liquid ready in the collecting space 132 (provided the shut-off valve 139 is open).

The second surface 130 faces into a space 144 that is connected to the outside 128 in a manner activated by pressure.

Between the collecting space 132 and the space 144 there is formed a fluid path 146 that is configured to be opened and closed. Depending on the position of the pressure-controlled switch 118, liquid can flow out of the collecting space 132 and into the space 144. Depending on the position of the shut-off valve 124, this fluid path 146 is shut off or open.

Depending on the pressure prevailing at the first surface 126, there is a pressure difference, or no pressure difference, between the second surface 130 and the first surface 126.

In a mode of the surface cleaning machine in which the suction fan 34 is operated, there is at the first surface 126 a negative pressure in relation to the outside 128 that is greater than a threshold value. There is thus a significant pressure difference between the second surface 130 and the first surface 126.

Arranged opposite the shut-off element 124 is a wall 148 that has an abutment surface 150 for the shut-off element 124.

If there is no pressure difference between the second surface 130 and the first surface 126, or the threshold for the pressure difference is not exceeded, the shut-off element 124 abuts against the abutment surface 150 and the fluid path 146 is shut off; the corresponding collecting space 132 and the space 144 are fluidically separated.

If there is sufficient pressure difference between the second surface 130 and the first surface 126, the shut-off element 124 is raised away from the abutment surface 150 and the fluid path 146 is opened. Cleaning liquid can flow into the space 144 from the collecting space 132 and thus from the reservoir device 42.

In a cleaning mode of the surface cleaning machine 10, in which a suction stream is present in the suction duct 44 and hence also the second region 50 and third region 52, a negative pressure is applied correspondingly to the first surface 126 and causes the shut-off element 124 to be raised away from the abutment surface 150, and keeps the shut-off element 124 in this raised-away position. The raised-away position is an open position of the pressure-controlled switch 118.

When the shut-off element 124 abuts against the abutment surface 150, this is a closed position of the pressure-controlled switch 118, shutting off the fluid path 146.

The pressure-controlled switch 118 has a reset device which, if the pressure difference between the first surface 126 and the second surface 130 is below the threshold, resets the shut-off element 124 to the closed position, with the shut-off element 124 abutting against the abutment surface 150.

In one exemplary embodiment, the reset device is produced by means of the inherent resilience of the membrane 122.

The transfer from the open position to the closed position, or vice versa, of the pressure-controlled switch 118 is directly linked to operation of the suction fan 34; the required negative pressure for moving and holding the membrane 122 in the open position is produced by the suction stream that is generated by the suction unit arrangement 32.

A distributor 152 is associated with the pressure-controlled switch 118 and in particular with a plurality of pressure-controlled switches 118. The distributor 152 serves to distribute cleaning liquid to the cleaning roller 18 and in particular to the application of liquid thereto, over the length of the cleaning roller 18.

In one exemplary embodiment, the distributor 152 takes the form of a channel 154. The channel 154 receives cleaning liquid up to a certain level. It can collect cleaning liquid.

The channel 154 extends parallel to the longitudinal axis 70 of the cleaning roller 18 and hence parallel to the axis of rotation 68.

It is in particular arranged in the space 144.

It extends in particular over a length corresponding to the length of the cleaning roller 18 along the longitudinal axis 70, with the result that cleaning liquid may be applied to the cleaning roller 18 over its entire length.

Associated with the channel 154 is an outlet opening device 156 that extends in particular over the entire length of the cleaning roller 18.

The channel 154 has a half-shell shape. As a result, it has a discharge opening 158 for cleaning liquid over its entire length.

The distributor 152 having the channel 154 can collect cleaning liquid. This forms an intermediate buffer for cleaning liquid. Cleaning liquid does not necessary flow directly on the fluid path 146 to the cleaning roller 18 but is collected accordingly in the channel 154.

Depending on the location of the distributor 152 in relation to the direction of gravity g, and hence depending on the location and angular position of the longitudinal axis 20 of the surface cleaning machine 10 in relation to the surface 16 to be cleaned, cleaning liquid can or cannot flow out of the distributor 152. An angular position of the surface cleaning machine 10 in relation to the surface 16 to be cleaned is indicated in FIG. 1 by the reference numeral 160. This angular position 160 can vary. The surface cleaning machine 10 is supported on the surface 16 to be cleaned by means of the cleaning roller 18. A contact region 162 of the cleaning roller 18 on the surface 16 to be cleaned forms a pivot axis for varying the angular position 160.

The channel 154 is arranged such that, when a particular pivot angle of the angular position 160 is reached, cleaning liquid can flow out of the channel 154 directly to the cleaning roller 18 (FIG. 8).

FIG. 7 shows a location of the distributor 152 in relation to the direction of gravity g in which the outlet opening device 156 is at a higher gravitational potential than the channel 154.

FIG. 8 shows a position in which the outlet opening device 156 is at a lower gravitational potential than the channel 154.

In the latter case, cleaning liquid can flow out of the channel 154 directly to the cleaning roller 18 and apply cleaning liquid to the latter.

In this embodiment, liquid is applied to the cleaning roller 18 in a manner controlled by gravity, by way of the angular position 160. The angular position 160 is, for its part, adjusted by manual operation by the person operating the machine.

Depending on whether a certain minimum pivot angle for the angular position 160 has been reached, cleaning liquid is applied or is not applied to the cleaning roller 18. This is determined by the vertical spacing in relation to the direction of gravity between the outlet opening device 156 and the channel 154.

In an advantageous exemplary embodiment, one or more slot channels 162 are arranged between the space or spaces 144 and the outlet opening device 156. Cleaning liquid from the channel 154 must pass through a corresponding slot channel 162 in order to be able to reach the cleaning roller 18.

A slot channel 162 is in particular formed with dimensions such that a capillary effect occurs for the flow of cleaning liquid. A capillary effect of this kind is favorable for an even distribution of cleaning liquid over the entire length of the cleaning roller 18. In particular, the slot channel 162 extends substantially over the entire length of the cleaning roller 18.

A jacket 56 of the cleaning roller 18 abuts, or almost abuts, by means of individual fibers against the outlet opening device 156 of the slot channel 162 during rotation of the cleaning roller 18. This generates a (slightly) negative pressure at the distributor 152, which entrains cleaning liquid. Moreover, cleaning liquid is drawn out of the slot channel 162 by the capillary action of fibers of the jacket. This ensures that cleaning liquid is applied to the cleaning roller 18 evenly.

The supply of cleaning liquid to the cleaning roller 18 takes a form without pumps. The pressure-controlled switch 118 is coupled directly to an action of the suction stream of the suction fan 34. Consequently, no additional control, in particular electronic control, is required for wetting the cleaning roller 18. In particular, no solenoid valves or similar are provided.

The surface cleaning machine 10 according to the invention functions as follows:

For a cleaning mode, the surface cleaning machine 10 is supported on the surface 16 to be cleaned by way of the cleaning roller 18. A person operating the machine stands on the surface 16 to be cleaned, behind the surface cleaning machine 10, and holds the latter for example with one hand by the handle 24.

The person operating the machine is able to perform a forward push in the forward direction 164.

In a cleaning mode, the suction fan 34 generates a suction stream that brings about, in the suction duct 44 and hence in the regions 46, 50 and 52, a negative pressure in relation to the outside 128.

The drive motor 78 generates a torque that is transmitted to the cleaning roller 18 by way of the transmission 84. The cleaning roller 18 is driven in rotation. In particular, it is driven in rotation counterclockwise (indicated in FIG. 1 by the reference numeral 166).

It is provided in particular for the cleaning roller 18 to be driven at a peripheral speed in the range between 0.9 m/s and 1.2 m/s, and in particular at a peripheral speed greater than 0.92 m/s and in particular less than 1.15 m/s.

For example, it is driven at a peripheral speed in the range between 0.95 m/s and 1.05 m/s. For example, it is driven at a peripheral speed of approximately 1 m/s.

In principle, it may be provided for the peripheral speed to be adjustable by a person operating the machine. In a structurally simple embodiment, the drive device 76 establishes the peripheral speed.

The cleaning roller 18 has a jacket 56 that is compressible. The jacket 56 is in particular made from a textile material.

Thus, the peripheral speed as mentioned above does not relate to a maximum diameter of the cleaning roller 18 but to a diameter when the jacket 56 is compressed, for example by the force of the weight of the surface cleaning machine 10.

Too low a peripheral speed has the effect that the surface cleaning machine simply rolls over the surface 16 to be cleaned, without sufficient cleaning effect. Too great a peripheral speed has the effect that cleaning liquid is splashed.

The peripheral speeds mentioned are in particular calculated on the basis of a working speed (forward speed) of the person operating the machine of approximately 0.9 m/s.

The wetting device 116 wets the cleaning roller 18 with cleaning liquid from the reservoir device 42. Here, liquid is applied without pumps and in particular without solenoid valves.

As a result of the action of gravity, cleaning liquid flows out of the reservoir device 42 to the collecting space or spaces 132. (In an embodiment in which the reservoir device is seated on the cleaning head, the reservoir device may itself form a collecting space.)

If a negative pressure is applied to the suction duct 44 with the regions 50, 52, the pressure-activated connection to the pressure-controlled switch or switches 118 ensures that the fluid path or paths 146 is/are opened. It is then possible for cleaning liquid to collect in the distributor 152 and from there to be applied to the cleaning roller 18. Here, an even application over substantially the entire length of the cleaning roller 18 along the longitudinal axis 70 is ensured.

A capillary action by means of one or more slot channels 162 can be favorable for an even distribution.

A cleaning mode without the application of liquid ("suction mode") is possible by (manually) shutting off the shut-off valve 139.

By predetermining the angular position 160, a person operating the machine may set whether or not cleaning liquid flows out of the distributor 152 to the cleaning roller 18. This setting is controlled by gravity, depending on whether the outlet opening device 156 is located above or below the channel 154 in relation to the direction of gravity, with where necessary capillary forces through the slot channel 162 being provided and an effect of negative pressure being provided by the fact that fibers of the jacket 56 abut against the outlet opening device 156.

Dirt on the surface 16 to be cleaned is softened by cleaning liquid and can then be carried along by way of the cleaning roller 18.

Removal by suction is performed by means of the suction stream that is generated, by way of the suction nozzle 54 or corresponding suction nozzles. At the separating device 38, a separation into solid dirt particles and liquid is performed. Dirty liquid is collected in the reservoir device 40.

The joint 62 allows corners or edges, for example, also to be cleaned mechanically. The device body 12 is pivotal in relation to the cleaning head 14 about the pivot axis 64, within the pivot range.

The relatively heavy drive motor 78 is arranged far down, in the vicinity of the cleaning head 14, in a normal operating mode, and is located at least partly on the joint 62 in space-saving manner. In this arrangement, it can be located at least partly outside the cleaning head 14 (at a spacing from the cleaning roller 18).

The sweeping element 98 allows coarse dirt to be swept, whereupon it may be carried along by the cleaning roller 18.

LIST OF REFERENCE NUMERALS

10 Surface cleaning machine
12 Device body
14 Cleaning head
16 Surface to be cleaned
18 Cleaning roller
20 Longitudinal axis
22 Rod
24 Handle
26 Switch
28 Housing
30 Hook device
32 Suction unit arrangement
34 Suction fan
36 Motor
38 Separating device
40 Reservoir device for dirty liquid
42 Reservoir device for cleaning liquid
44 Suction duct
46 First region
48 Branch point
50 Second region
52 Third region
54 Suction nozzle
56 Jacket
58 First nozzle wall
60 Second nozzle wall
62 Joint
64 Pivot axis
66 Acute angle
68 Axis of rotation
70 Longitudinal axis
72 Inner sleeve
74 Outer sleeve
76 Drive device
78 Drive motor
80 Motor shaft
82 Drive axis
84 Transmission
86 Speed reducer
88 Angular gear
90 First end side
92 Second end side
94 Housing
96 Cleaning roller holder
98 Sweeping element
100 Central region
102 Drive element
104 Belt
106 First pin
108 Second pin
110 First part
112 Second part
114 Gap
116 Wetting device
118 Pressure-controlled switch
120 Double-headed arrow
122 Membrane
124 Shut-off element
126 First surface
128 Outside
130 Second surface
132 Collecting space
134 Line
136 Connector
138 Distributor line
139 Shut-off valve
140 First connector point
142 Second connector point
144 Space

146 Fluid path
148 Wall
150 Abutment surface
152 Distributor
154 Channel
156 Outlet opening device
158 Discharge opening
160 Angular position
162 Slot channel
164 Forward direction
166 Counterclockwise direction

The invention claimed is:

1. A surface cleaning machine, comprising:

at least one cleaning roller;

a drive device for rotary driving of the at least one cleaning roller, a distributor for distributing cleaning liquid to the at least one cleaning roller, a wetting device for applying the cleaning liquid to the at least one cleaning roller, and a suction unit arrangement for generating a suction stream, which is fluidically connected to at least one suction duct and at least one suction nozzle that is associated with the at least one cleaning roller, wherein the wetting device includes at least one pressure-controlled switch that, in an open position, opens a fluid path for cleaning liquid to the at least one cleaning roller and, in a closed position, shuts off the fluid path, wherein the at least one pressure-controlled switch is coupled to the at least one suction duct in a manner activated by pressure, wherein, in the event of the application of a negative pressure brought about by a suction stream in the at least one suction duct, the at least one pressure-controlled switch at least one of (i) moves into the open position and (ii) maintains the open position, and wherein the distributor is arranged downstream of the at least one pressure-controlled switch and is fluidically connected to the fluid path, and wherein the distributor has an outlet opening device that is arranged and formed such that, depending on an angular position of the distributor in relation to the direction of gravity, cleaning liquid flows or does not flow out of the distributor to the at least one cleaning roller.

2. The surface cleaning machine according to claim 1, comprising at least one collecting space for cleaning liquid, wherein the fluid path that is controllable, in terms of opening and closing, by the at least one pressure-controlled switch lies between the at least one collecting space and the at least one cleaning roller.

3. The surface cleaning machine according to claim 1, comprising a reservoir device for cleaning liquid that is fluidically connected to the fluid path and is in particular fluidically connected to at least one collecting space for cleaning liquid.

4. The surface cleaning machine according to claim 3, wherein, in a normal operating mode of the surface cleaning machine, the reservoir device is located above the at least one cleaning roller in relation to the direction of gravity.

5. The surface cleaning machine according to claim 1, wherein the at least one pressure-controlled switch has a first surface, which is connected to the at least one suction duct in a manner activated by pressure, and a second surface, which is connected to the outside in a manner activated by pressure, and wherein a pressure difference between the first surface and the second surface determines the position of the at least one pressure-controlled switch.

6. The surface cleaning machine according to claim 5, wherein the application of a negative pressure on the at least one suction duct brings about a pressure difference between the first surface and the second surface that at least one of (i) moves the at least one pressure-controlled switch into the open position and (ii) keeps it in the open position.

7. The surface cleaning machine according to claim 6, wherein the at least one pressure-controlled switch has a reset device which, if a minimum threshold of the pressure difference is not reached, at least one of (i) performs a reset to the closed position and (ii) maintains the closed position.

8. The surface cleaning machine according to claim 7, wherein the reset device is formed by an inherent resilience of the at least one pressure-controlled switch.

9. The surface cleaning machine according to claim 1, wherein the at least one pressure-controlled switch has a movable membrane.

10. The surface cleaning machine according to claim 1, wherein the at least one pressure-controlled switch has at least one movable shut-off element for the fluid path, arranged in particular at a movable membrane.

11. The surface cleaning machine according to claim 1, wherein the distributor includes at least one channel or is formed by at least one channel.

12. The surface cleaning machine according to claim 11, wherein the at least one channel at least one of (i) extends at least approximately parallel to a longitudinal axis of the at least one cleaning roller and (ii) extends at least approximately parallel to an axis of rotation of the at least one cleaning roller.

13. The surface cleaning machine according to claim 11, wherein the at least one channel extends, by means of an outlet opening device, over at least 80% of a length of the at least one cleaning roller and in particular over an entire length of the at least one cleaning roller.

14. The surface cleaning machine according to claim 11, wherein the at least one channel has a half-shell shape.

15. The surface cleaning machine according to claim 1, wherein the angular position of the distributor in relation to the direction of gravity is determined by an angular position of a longitudinal axis of the surface cleaning machine in relation to a surface to be cleaned.

16. The surface cleaning machine according to claim 1, wherein the at least one cleaning roller is wetted by way of the distributor in a gravity-controlled manner.

17. The surface cleaning machine according to claim 1, wherein, in regard to wetting the at least one cleaning roller with the wetting device, the surface cleaning machine takes a form without pumps.

18. The surface cleaning machine according to claim 1, wherein the fluid path has at least one slot channel that in particular takes a form such that a capillary effect occurs for the flow of cleaning liquid.

19. The surface cleaning machine according to claim 18, wherein a jacket of the at least one cleaning roller abuts, or almost abuts, against an outlet opening device of the at least one slot channel.

20. The surface cleaning machine according to claim 18, wherein a distributor for cleaning liquid is upstream of the at least one slot channel, in relation to a direction of flow for cleaning liquid.

21. The surface cleaning machine according to claim 1, wherein in a cleaning mode the surface cleaning machine is supported on the surface to be cleaned only by way of a cleaning roller that is driven in rotation.

22. A surface cleaning machine, comprising:

at least one cleaning roller;

a drive device for rotary driving of the at least one cleaning roller, a distributor for distributing cleaning liquid to the at least one cleaning roller, a wetting device for applying the cleaning liquid to the at least one cleaning roller, and a suction unit arrangement for generating a suction stream, which is fluidically connected to at least one suction duct and at least one suction nozzle that is associated with the at least one cleaning roller, wherein the wetting device includes at least one pressure-controlled switch that, in an open position, opens a fluid path for cleaning liquid to the at least one cleaning roller and, in a closed position, shuts off the fluid path, wherein the at least one pressure-controlled switch is coupled to the at least one suction duct in a manner activated by pressure, wherein, in the event of the application of a negative pressure brought about by a suction stream in the at least one suction duct, the at least one pressure-controlled switch at least one of (i) moves into the open position and (ii) maintains the open position, and wherein the distributor is arranged downstream of the at least one pressure-controlled switch and is fluidically connected to the fluid path, wherein the distributor includes at least one channel or is formed by at least one channel, the at least one channel having a half-shell shape.

* * * * *